US007318546B2

(12) United States Patent
Segura et al.

(10) Patent No.: US 7,318,546 B2
(45) Date of Patent: Jan. 15, 2008

(54) ADJUSTABLE DEPTH-OF-DRIVE MECHANISM FOR A FASTENER DRIVING TOOL

(75) Inventors: Ricardo Segura, Lake in the Hills, IL (US); Bryan Schieler, Sycamore, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/256,739

(22) Filed: Oct. 24, 2005

(65) Prior Publication Data

US 2007/0090149 A1 Apr. 26, 2007

(51) Int. Cl.
*B25C 1/04* (2006.01)

(52) U.S. Cl. ..... 227/142; 227/8; 227/130

(58) Field of Classification Search ..... 227/8, 227/130, 142

See application file for complete search history.

(56) References Cited

U.S. PATENT DOCUMENTS

| | | | | |
|---|---|---|---|---|
| 5,219,110 | A | 6/1993 | Mukoyama | |
| 5,261,587 | A | 11/1993 | Robinson | |
| 5,385,286 | A | 1/1995 | Johnson, Jr. | |
| 5,564,614 | A | 10/1996 | Yang | |
| 5,685,473 | A | 11/1997 | Shkolnikov et al. | |
| 5,839,638 | A | 11/1998 | Ronn | |
| 6,012,622 | A | 1/2000 | Weinger et al. | |
| 6,024,267 | A * | 2/2000 | Chen | 227/8 |
| 6,170,729 | B1 | 1/2001 | Lin | |
| 6,186,386 | B1 | 2/2001 | Canlas et al. | |
| 6,581,815 | B1 * | 6/2003 | Ho et al. | 227/142 |
| 6,695,192 | B1 | 2/2004 | Kwok | |
| 6,851,595 | B1 * | 2/2005 | Lee | 227/142 |
| 6,857,547 | B1 * | 2/2005 | Lee | 227/8 |
| 2002/0121540 | A1 | 9/2002 | Taylor et al. | |
| 2004/0238593 | A1 * | 12/2004 | Tachihara et al. | 227/142 |
| 2005/0189390 | A1 | 9/2005 | Taylor et al. | |

* cited by examiner

*Primary Examiner*—Rinaldi I. Rada
*Assistant Examiner*—Michelle Lopez
(74) *Attorney, Agent, or Firm*—Greer, Burns & Crain, Ltd.; Lisa M. Soltis; Mark W. Croll

(57) ABSTRACT

An adjustable depth-of-drive mechanism for a fastener driving tool having a housing structure defining an axis, and a nosepiece extending generally axially from the housing structure, includes a lower work contact element having a sleeve for reciprocatingly receiving the nosepiece, an upper work contact element attached at a first end to the housing structure, a rotatable thumbwheel assembly having a first portion engageable with the lower work contact element, a thumbwheel assembly accessible by a user and a second portion having at least one detent assembly, and a retaining mechanism for retaining the thumbwheel assembly relative to the upper work contact element where the second portion is received by a second end of the upper work contact element, where during thumbwheel rotation relative to the first portion in either direction, the position of the lower work contact element is moved relative to the nosepiece.

5 Claims, 6 Drawing Sheets

ADJUSTABLE DEPTH-OF-DRIVE MECHANISM FOR A FASTENER DRIVING TOOL

BACKGROUND OF THE INVENTION

The present invention relates generally to fastener driving tools such as pneumatic tools, cordless framing and trim tools and the like. More particularly, the present invention relates to an adjustable depth-of-drive mechanism for a fastener driving tool.

As exemplified in U.S. Pat. No. 6,543,644, which is incorporated by reference, fastening tools, and particularly pneumatic framing tools for use in driving fasteners into workpieces, are described. Such fastener driving tools are commercially available from ITW-Paslode (a division of Illinois Tool Works, Inc.) of Vernon Hills, Ill.

Such tools incorporate a housing enclosing an air pressure cylinder. Slidably mounted within the cylinder is a piston assembly that divides the cylinder into a drive chamber on one side of the piston assembly and a return chamber on the opposite side thereof. The piston assembly includes a piston head and a rigid driver blade that is disposed within the cylinder. A movable valve plunger is oriented above the piston head.

Upon the pulling of a trigger, a trigger valve closes and opens a passageway to the atmosphere. At this point, the air pressure in the drive chamber is higher than that in the return chamber, causing the piston and driver blade to be actuated downward to impact a positioned fastener and drive it into the workpiece. Fasteners are fed into the nosepiece from a supply assembly, such as a magazine, where they are held in a properly positioned orientation for receiving the impact of the driver blade.

As the piston is actuated downward, it drives the air inside the cylinder through a series of holes into the return air chamber. After the trigger is released, compressed air pushes the valve plunger back into place, blocking the airflow to the piston head. At this time, there is no downward pressure, so the compressed air in the return chamber can push the piston head back up. The air above the piston head is forced out of the tool and into the atmosphere.

Although a pneumatic framing tool has been described above, other types of fastener driving tools, such as combustion, powder activated and/or electrically powered tools are well known in the art, and are also contemplated for use with the present depth-of-drive adjustment mechanism.

One operational characteristic required in fastener driving applications is the ability to predictably control fastener driving depth. For the sake of appearance, some applications require fasteners to be countersunk below the surface of the workpiece, others require the fastener to be driven flush with the surface of the workpiece, and some may require the fastener to stand off above the surface of the workpiece. Depth adjustment has been achieved in pneumatically and combustion powered tools through a tool controlling mechanism, referred to as a drive probe, that is movable in relation to the nosepiece of the tool. The range of movement of the drive probe typically defines a range for fastener depth of drive.

One disadvantage of previous depth adjusting mechanisms is that they allow only one type of adjustment, usually gross adjustment. In this mode, a lock is released and the drive probe moves relatively freely relative to the nosepiece. Once the desired adjustment is achieved, the probe is locked in position. Many projects require the user to accurately set the depth of drive at a specific measurement. This can be difficult to accomplish when the adjusting mechanism only allows for gross adjustments, and therefore the user may have to adjust the depth of drive several times through trial and error in order to obtain the correct measurement for the depth of drive.

In other tools, the only type of adjustment offered is fine adjustment, which is provided using a biased detent engaging a rotating adjuster or barrel. However, many such systems have been known to lose their desired position over periods of extended use due to repeated tool impact.

Accordingly, there is a need for a single depth-of-drive adjustment mechanism for use in a fastener driving tool that allows the user the option of adjusting the mechanism in both a fine or a gross adjustment setting.

There also exists a need to provide a depth-of-drive mechanism for a fastener driving tool that is easily accessible and that can be manipulated by both experienced construction workers, contractors and laymen alike.

Further, there exists a need for a depth-of-drive mechanism that is strong enough to maintain its adjustment positioning despite repeated tool impact.

SUMMARY OF THE INVENTION

The above-listed needs are met or exceeded by the present adjustable depth-of-drive mechanism for a fastener driving tool, such as a pneumatic type framing tool or the like.

The present adjustable depth-of-drive mechanism provides a device which can be easily manipulated by both experienced contractors and laymen alike. Further, the present adjustable depth-of-drive mechanism provides for both fine and gross adjustments, allowing the user to adjust the mechanism based on the needs of the application. Also, the present adjustable depth-of-drive mechanism is strong enough to maintain a desired depth position, despite repeated and continuous tool impact.

Specifically, the present adjustable depth-of-drive mechanism for a fastener driving tool having a housing structure which defines an axis, and a nosepiece which extends generally axially from the housing structure, includes a lower work contact element having a sleeve configured for reciprocatingly receiving the nosepiece, and an upper work contact element attached at a first end to the housing structure. A rotatable thumbwheel assembly has a first portion engageable with the lower work contact element, a thumbwheel accessible by a user and a second portion having at least one detent assembly. The second portion is configured for being received by a second end of the upper work contact element. The adjustable depth-of-drive mechanism further includes a retaining mechanism for retaining the thumbwheel assembly relative to the upper work contact element. When the thumbwheel is rotated relative to the first portion in either direction, the position of the lower work contact element is moved relative to the nosepiece.

DETAILED DESCRIPTION OF THE INVENTION

Figure 1:
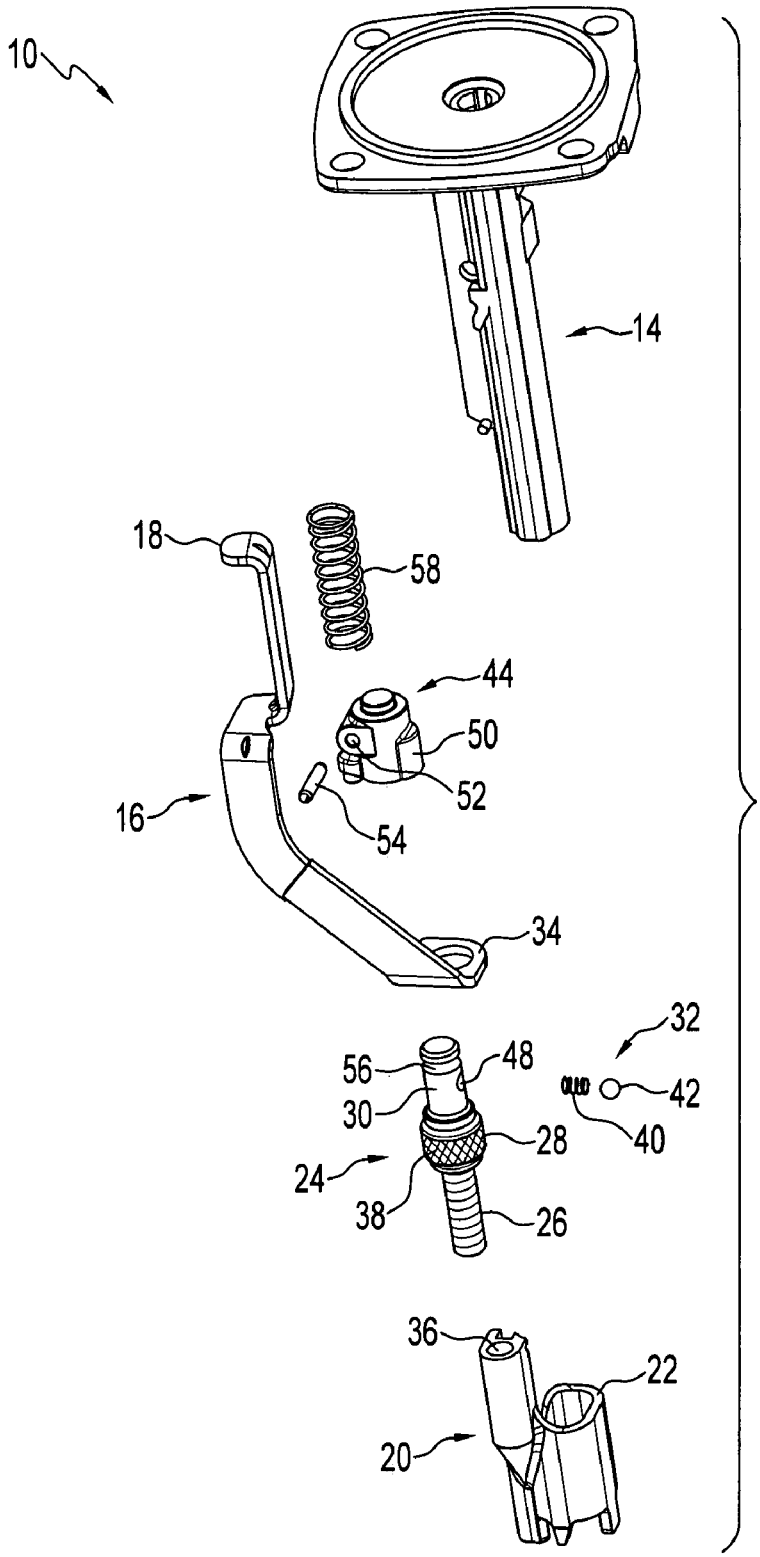
FIG. 1 is an exploded perspective view of the present adjustable depth-of-drive mechanism.
Figure 2:
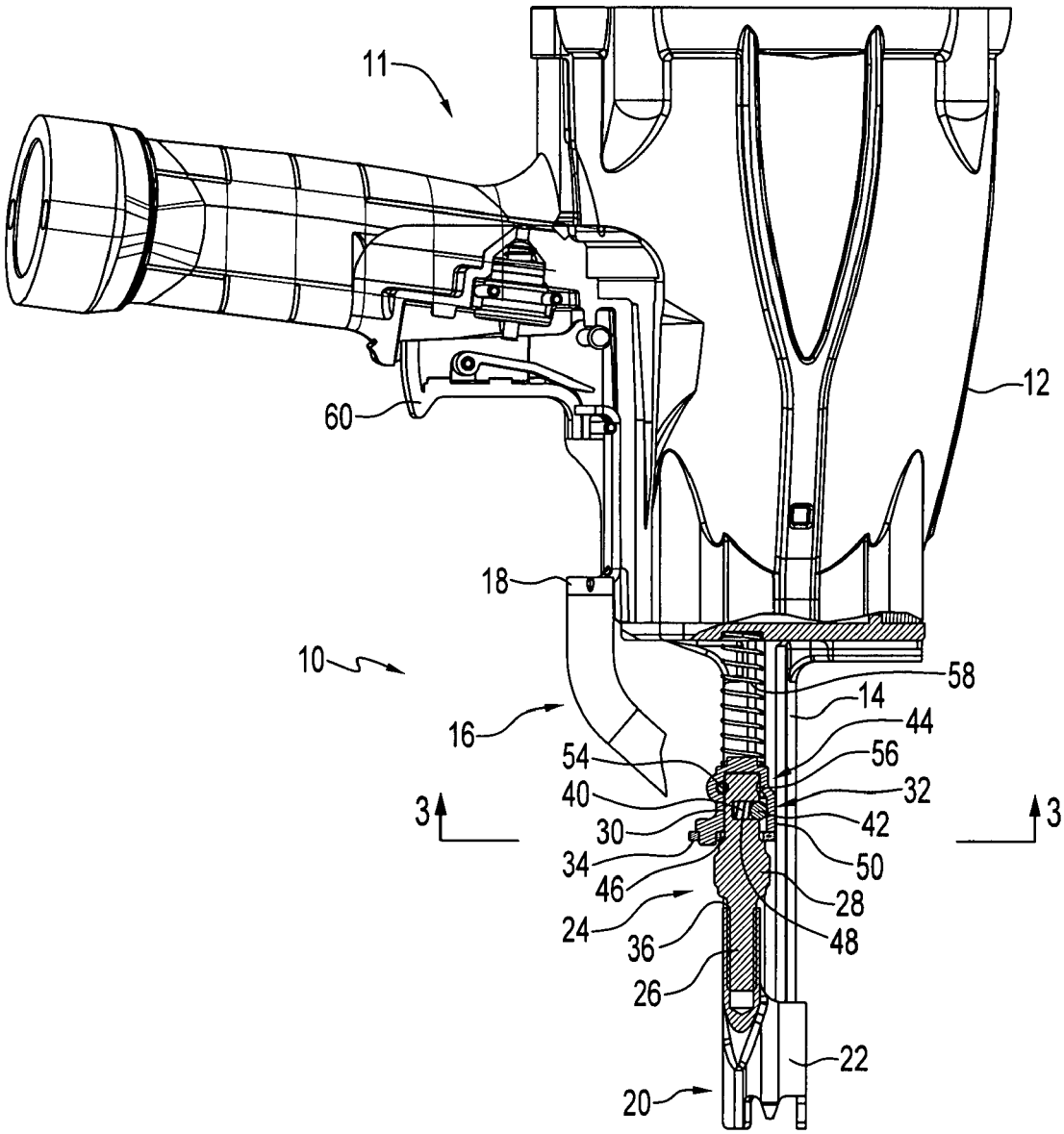
FIG. 2 is a fragmentary side view, in partial cross-section of the present adjustable depth-of-drive mechanism shown assembled in a fastener driving tool.

As seen in FIGS. 1 and 2, an adjustable depth-of-drive mechanism for a fastener driving tool is generally designated 10. A tool 11 includes a housing structure 12 which defines an axis and encloses an air cylinder (not shown), and a nosepiece 14 which extends generally axially from the housing structure.

Best shown in FIGS. 1, 2 and 5-7, the adjustable depth-of-drive mechanism 10 includes an upper work contact element 16 attached at a first end 18 to the housing structure 12. Preferably, the first end 18 is mounted on the housing structure 12 in a lower rearward position on the housing in a track (not shown) configured for vertical sliding movement, as is known in the art. The upper work contact element 16 is constrained on the track with the aid of a roll pin (not shown), as is also known in the art. However, it is appreciated that other methods for attaching the upper work contact element 16 to the housing 12 are available, as are known in the art.

A lower work contact element 20 has a sleeve 22 configured for reciprocatingly receiving the nosepiece 14, as shown in FIGS. 1, 2 and 5-7. However, it is contemplated that other arrangements are possible for slidably receiving the nosepiece 14, as are known in the art.

Figure 5:
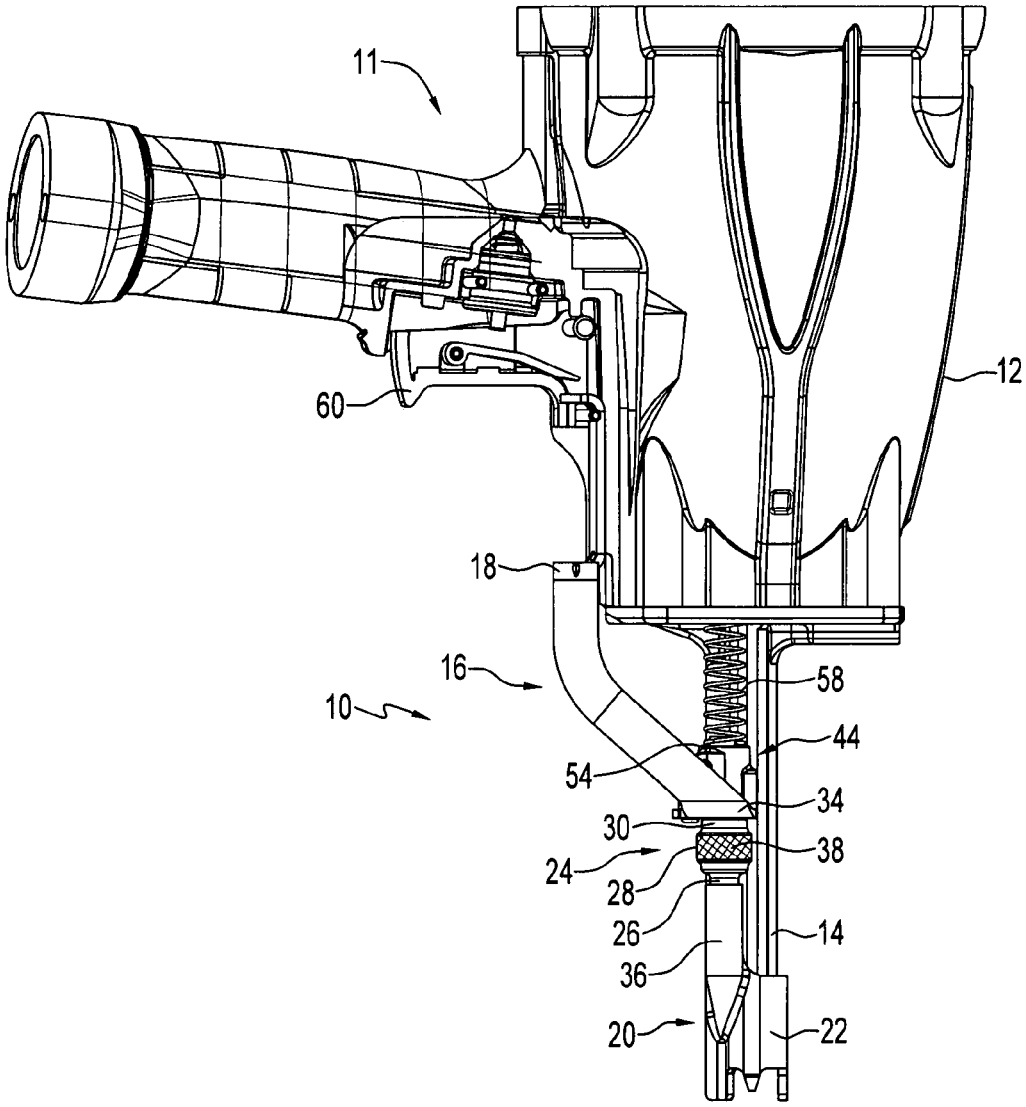
FIG. 5 is a side view of the present adjustable depth-of-drive mechanism shown assembled in the fastener driving tool and showing the tool in a rest position.
Figure 6:
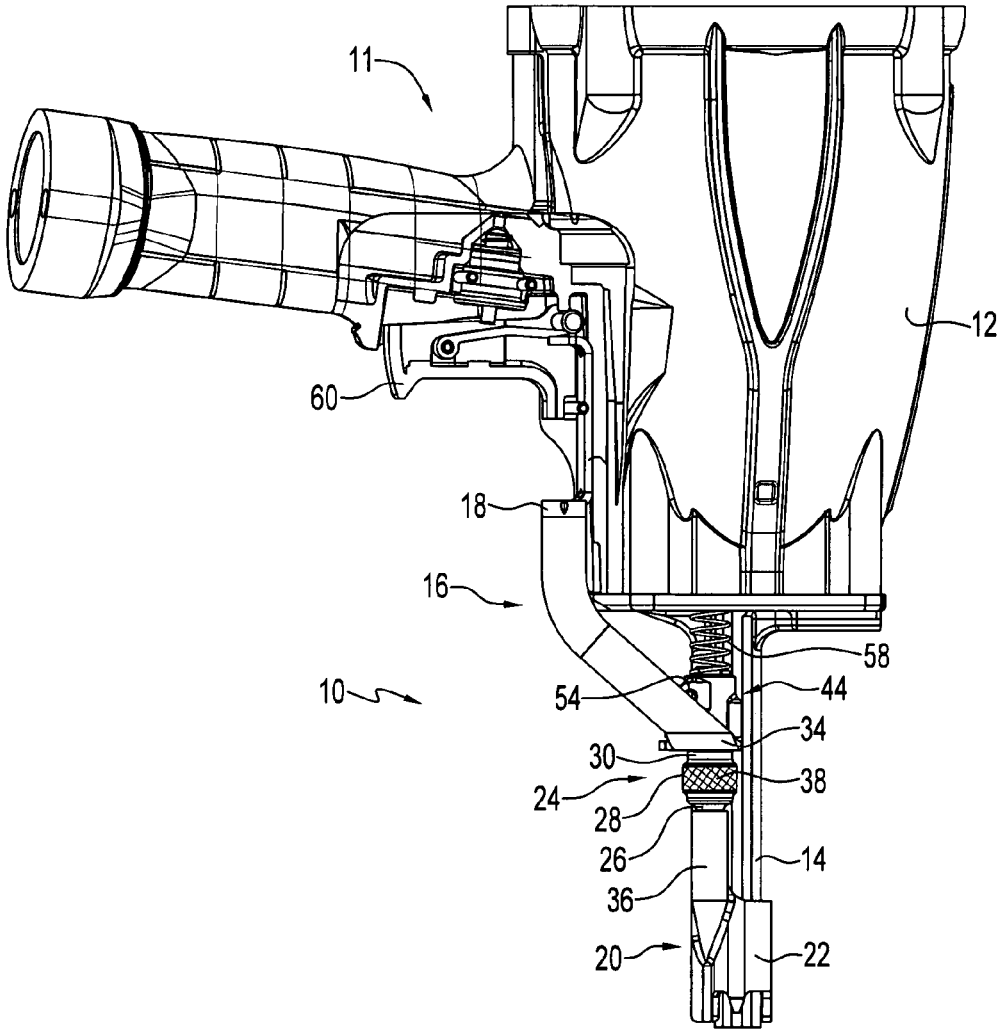
FIG. 6 is a side view of the present adjustable depth-of-drive mechanism shown assembled in the fastener driving tool and showing the mechanism set to flush and the tool ready to be actuated.
Figure 7:
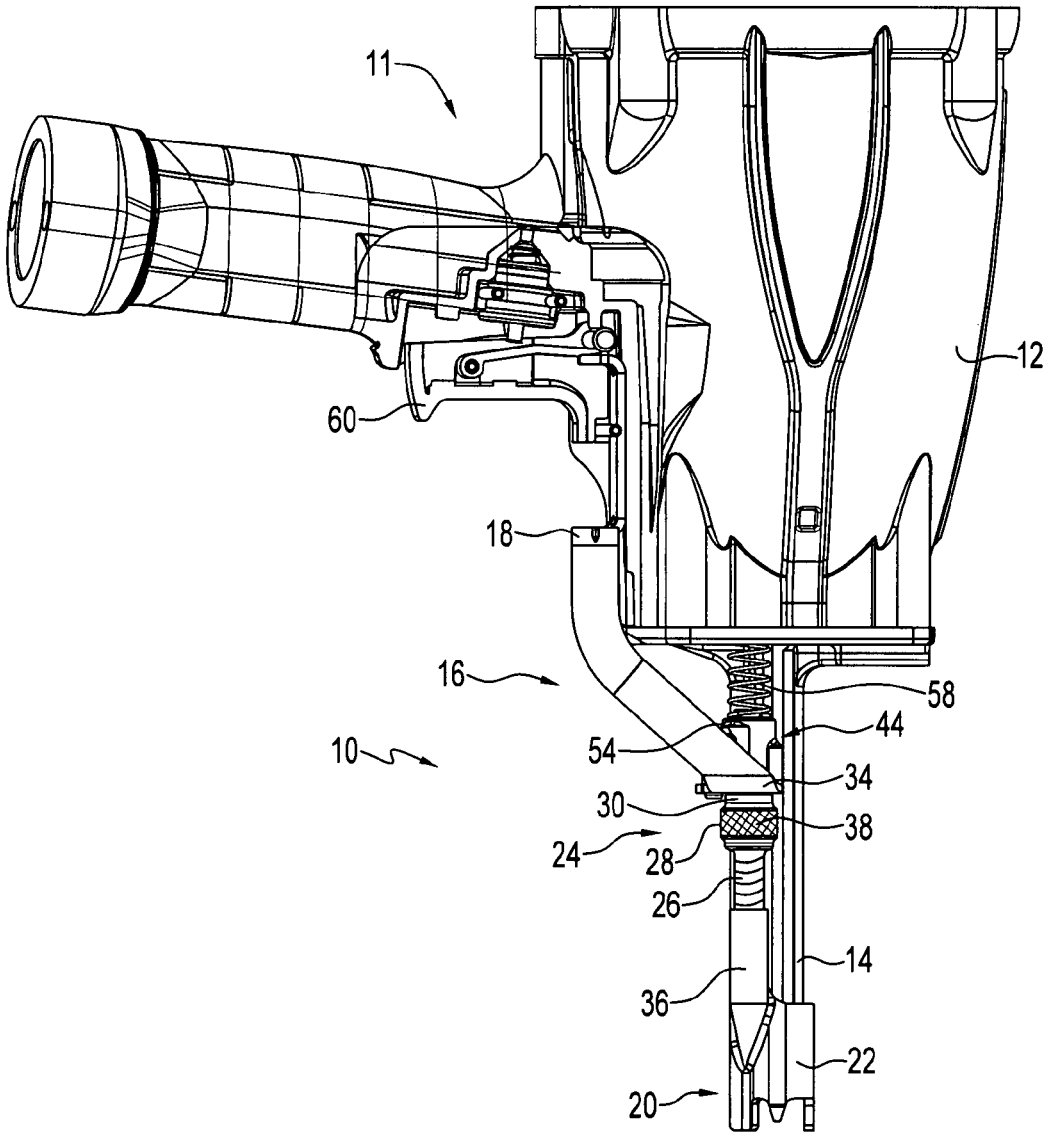
FIG. 7 is a side view of the present adjustable depth-of-drive mechanism shown assembled in the fastener driving tool and showing the mechanism set above flush and the tool ready to be actuated.

The mechanism 10 further includes a rotatable thumbwheel assembly 24 having a first portion 26 engageable with the lower work contact element 20, a thumbwheel 28 accessible by a user and a second portion 30 having at least one detent assembly 32. The second portion 30 is configured for being received by a second end 34 of the upper work contact element 16. As shown in FIGS. 5-7, the thumbwheel assembly 24 provides an indirect connection between the upper work contact element 16 and the lower work contact element 20, and provides a central assembly location for the mechanism 10.

Referring now to FIG. 1, the adjustable depth-of-drive mechanism 10 further includes a bore 36 on the lower work contact element 20. The bore 36 is preferably internally threaded and threadably engages the preferably externally threaded first portion 26 for adjusting the depth of drive of the fastener driving tool 11.

According to the present adjustable depth-of-drive mechanism 10, when the thumbwheel 28 is rotated by the user relative to the first portion 26 in either direction, the position of the lower work contact element 20 is moved relative to the nosepiece 14. Because of the threaded engagement between the first portion 26 and the bore 36, it is contemplated that the mechanism 10 can provide both fine and gross depth adjustments depending on the number of 360° rotations of the thumbwheel 28.

As shown in FIGS. 1 and 5-7, the thumbwheel 28 includes a textured outer surface 38, such as checkering, ribs, flutes or the like. Further, it is preferred that the thumbwheel 28 has a larger diameter than the first and second portions 26, 30, respectively. It is contemplated that by providing the thumbwheel 28 with the textured outer surface 38 and the larger diameter, the thumbwheel will be easier to manipulate by the user. In addition, because of the external location of the thumbwheel 28, it is contemplated that the thumbwheel can be easily accessed by the user from many directions, regardless of the placement of the tool 11 with respect to the workpiece.

Referring to FIGS. 1-4, the at least one detent assembly 32 includes a detent spring 40 and a detent element 42. As known in the art, the detent element 42 is generally spherical in shape, although it is appreciated that other shapes may be available.

As shown in FIGS. 1 and 2, the adjustable depth-of-drive mechanism 10 also includes a retaining mechanism 44 for retaining the thumbwheel assembly 24 relative to the upper work contact element 16. The retaining mechanism 44 is preferably a bushing having an orifice 46 configured for axially receiving the thumbwheel assembly second portion 30. The detent element 42 is urged by the detent spring 40 to protrude slightly out of a blind end bore 48 (FIGS. 2 and 3) in the second portion 30 in a locked position and is depressible to retract from the opening in an unlocked position (FIG. 4). It is contemplated that due to the biasing of the detent spring 40, the detent element 42 is moved between the locked and unlocked positions during rotation of the thumbwheel 28.

It is further contemplated that the opening 48 is generally cylindrical and configured to correspond with the generally spherical detent element 42, although, as mentioned above, it is appreciated that other shapes or configurations may be available.

Figure 3:
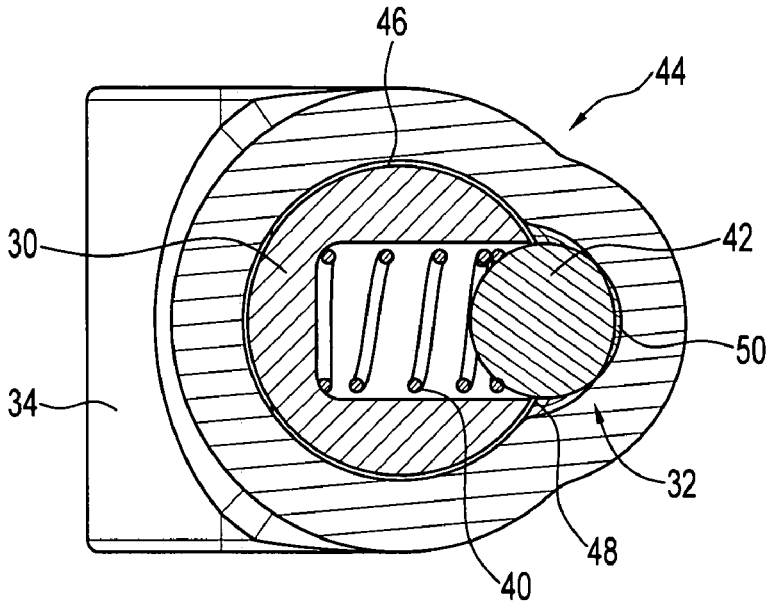
FIG. 3 is a cross-section taken along line 3-3 of FIG. 2 and in the direction generally indicated of a detent assembly of the present adjustable depth-of-drive mechanism in a locked position.
Figure 4:
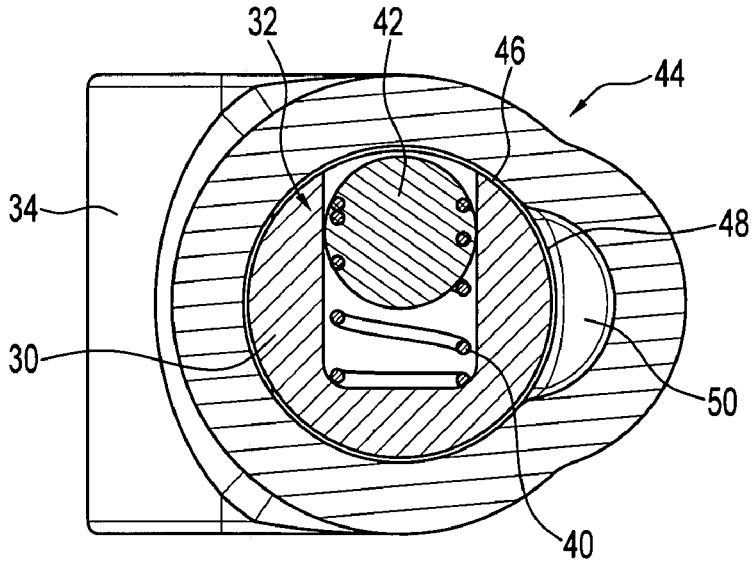
FIG. 4 is a cross-sectional view of the detent assembly of FIG. 3 in an unlocked position.

Referring now to FIGS. 3 and 4, the bushing orifice 46 includes a chamber 50 in communication with the orifice and configured for receiving the detent element 42 in the locked position. When the user rotates the thumbwheel 28 in either direction, the user action overcomes a detent assembly biasing force caused by the detent spring 40, releasably unlocking the detent element 42 from the bushing chamber 50 (FIG. 4). After the thumbwheel 28 has been rotated 360°, the detent element 42 will return to the locked position (FIG. 3). The bushing chamber 50 is preferably generally hemispherical in shape and is configured to correspond to the generally spherical detent element 42. However, it is recognized that other shapes may be available for the chamber 50, as are known in the art, so long as the chamber generally corresponds to the shape of the detent element 42.

Referring again to FIGS. 1 and 2, the retaining mechanism or bushing 44 includes a pinhole 52 for receiving a retaining pin 54, wherein the retaining pin removably engages the thumbwheel assembly second portion 30 relative to the upper work contact element 16. To further facilitate this connection, the second portion includes an annular groove 56 constructed and arranged for receiving the retaining pin 54. The retaining pin 54 thus passes through the pinhole 52 and engages the annular groove 56. It is contemplated that this engagement provides a secure rotatable connection between the upper work contact element 16 and the thumbwheel assembly 24, while at the same time providing a removable connection, as the retaining pin 54 can be slidably removed from the annular groove 56. Although one method of rotatably connecting the upper work contact element 16 and thumbwheel assembly 24 has been described herein, it is appreciated that other methods of attachment are available, as are known in the art.

Referring now to FIGS. 2 and 5-7, the adjustable depth-of-drive mechanism 10 further includes a biasing element 58 located between the housing structure 12 and the retaining mechanism 44. The biasing element 58 is configured for biasing the adjustable depth-of-drive mechanism 10 relative to the nosepiece 14 between a rest position and an actuating position (FIGS. 5 and 6-7, respectively). Specifically, when the tool 11 is pressed against a workpiece (not shown), both the lower work contact element 20 and the upper work contact element 16, which are held together by the thumbwheel assembly 24 and the retaining mechanism 44, are moved upwardly together into an operative position against the bias of the biasing element 58.

As the user rotates the thumbwheel 28 to adjust the depth-of-drive of fasteners driven by the tool 11, the lower work contact element 20 moves relative to the thumbwheel while the thumbwheel remains axially fixed but rotatable relative to the upper work contact element 16. As shown in FIGS. 6 and 7, during rotation of the thumbwheel 28, the depth-of-drive is altered based on the axial movement of the lower work contact element 20.

Specifically, FIG. 6 shows the thumbwheel assembly 24 at its "start" position, where the lower work contact element 22 is flush with a lower end of the nosepiece 14 and the thumbwheel 28 has not been rotated. As shown in FIG. 7, during rotation of the thumbwheel 28 in one direction, the lower work contact element 20 moves towards the workpiece (not shown) relative to the nosepiece 14, lengthening the depth of drive. The rest of the mechanism 10 remains stationary. Although not shown, the lower work contact element 20 would move away from the workpiece (not shown) if the thumbwheel 28 were rotated in the opposite direction, shortening the depth of drive. As stated above, the rest of the mechanism 10 remains stationary during the movement of the lower work contact element 20.

Depending on the number of 360° rotations of the thumbwheel 28, it is contemplated that the present adjustable depth-of-drive mechanism 10 can provide both fine and gross adjustment. Specifically, if the user would like to adjust the fastener depth of drive by only a small amount, it may only be necessary to rotate the thumbwheel 28 once or twice. However, if the user would like to adjust the fastener depth of drive by a larger amount, the thumbwheel 28 will need to complete several more 360° rotations. It is contemplated that by providing an adjustable depth-of-drive mechanism having a component that allows for both fine and gross adjustments of fastener depth-of-drive, the mechanism will be easy to use by both experienced contractors and laymen alike. Furthermore, it is contemplated that this design contains fewer components than depth-of-drive mechanisms that require separate mechanisms for performing fine and gross adjustments.

While a particular embodiment of the adjustable depth-of-drive mechanism has been described herein, it will be appreciated by those skilled in the art that changes and modifications may be made thereto without departing from the invention in its broader aspects and as set forth in the following claims.

The invention claimed is:

1. An adjustable depth-of-drive mechanism for a fastener driving tool having a housing structure which defines an axis, and a nosepiece which extends generally axially from the housing structure, comprising:

a lower work contact element having a sleeve configured for reciprocatingly receiving the nosepiece, and a bore;

an upper work contact element attached at a first end to the housing structure;

a rotatable thumbwheel assembly having a first portion threadably engageable with said bore, a thumbwheel accessible by a user and a second portion having at least one detent assembly, wherein said second portion is configured for being received by a second end of said upper work contact element;

said at least one detent assembly includes a detent spring and a detent element;

a retaining mechanism for retaining said thumbwheel assembly relative to said upper work contact element, wherein said retaining mechanism is a bushing having an orifice configured for receiving said thumbwheel assembly second portion, said bushing orifice includes a chamber in communication with said orifice and configured for receiving said detent element in a locked position, wherein when the user axially rotates said thumbwheel, the user action overcomes a detent assembly biasing force, releasably unlocking said detent element from said bushing chamber;

said bushing includes a retaining pin and a pinhole for receiving said retaining pin, wherein said retaining pin rotatably engages said thumbwheel assembly second portion relative to said upper work contact element;

said thumbwheel assembly has an annular groove constructed and arranged for rotatably receiving said retaining pin; and a biasing element located between the housing structure and said bushing and configured for biasing the adjustable depth-of-drive mechanism relative to the nosepiece between a rest position and an actuating position;

when said thumbwheel is rotated axially relative to said first portion, the position of said lower work contact element is moved relative to the nosepiece; and said detent assembly being located on said thumbwheel assembly between said annular groove and a radially enlarged portion of said thumbwheel.

2. The adjustable depth-of-drive mechanism of claim 1 wherein said thumbwheel includes a textured outer surface for easy gripping and rotation by the user.

3. The adjustable depth-of-drive mechanism of claim 1 wherein said second portion includes an opening for receiving said detent assembly, said detent element being urged to protrude slightly out of said opening in said locked position and being depressible to retract from said opening in an unlocked position, wherein said detent element moves between said locked and unlocked positions during rotation of said thumbwheel.

4. The adjustable depth-of-drive mechanism of claim 1 wherein said thumbwheel has a larger diameter than said thumbwheel first and second portions.

5. The adjustable depth-of-drive mechanism of claim 1 wherein said retaining pin engages said bushing in a location diametrically opposed from said chamber.

* * * * *